US005313685A

United States Patent [19]

Kramer et al.

[11] Patent Number: 5,313,685

[45] Date of Patent: May 24, 1994

[54] DEVICE FOR REMOVING LIQUID FROM THE SURFACE OF A MOVING STRIP

[75] Inventors: Carl Kramer; Bernd Konrath, both of Aachen; Bernd Berger, Kaarst; Peter Reinthal, Hemer, all of Fed. Rep. of Germany

[73] Assignee: Sundwiger Eisenhutte Maschinenfabrik GmbH, Hemer-Sundwig, Fed. Rep. of Germany

[21] Appl. No.: 880,204

[22] Filed: May 6, 1992 (Under 37 CFR 1.47)

[30] Foreign Application Priority Data

May 17, 1991 [DE] Fed. Rep. of Germany ..... 4116325

[51] Int. Cl.[5] ..... A47L 5/38

[52] U.S. Cl. ..... 15/309.1; 34/638; 134/15

[58] Field of Search ..... 34/155, 156, 160, 23, 34/22; 15/309.1, 306.1, 301, 300.1, 345, 346; 134/15

[56] References Cited

U.S. PATENT DOCUMENTS

| | | |
|---|---|---|
| 3,192,752 | 7/1965 | Dowd et al. . |
| 3,436,265 | 4/1969 | Gardner . |
| 3,607,366 | 9/1971 | Kurokawa . |
| 4,042,996 | 8/1977 | Wessels et al. . |
| 4,157,903 | 6/1979 | Kanda et al. . |
| 4,477,287 | 10/1984 | Kush et al. . |

FOREIGN PATENT DOCUMENTS

| | | |
|---|---|---|
| 135857 | 6/1979 | Fed. Rep. of Germany . |
| 3603041 | 10/1986 | Fed. Rep. of Germany . |
| 62-132567 | 6/1987 | Japan . |
| 1232236 | 5/1989 | Japan . |
| 789597 | 12/1980 | U.S.S.R. . |

*Primary Examiner*—Henry A. Bennett

*Attorney, Agent, or Firm*—Meltzer, Lippe, Goldstein, Wolf, Schlissel & Sazer

[57] ABSTRACT

A device for removing liquid from the surface of a moving strip (B), more particularly a rolled strip on a roll stand, by means of a gas, more particularly air, blown on to the moving strip (B), is characterized according to the invention in that disposed transversely of the direction (L) in which the strip runs is a slot nozzle (3) which is directed at the strip surface at an angle ($\beta$) of 45° to 90° of its jet oppositely to the direction (L) in which the strip runs, the ratio between the distance (h) of the slot nozzle (3) from the moving strip (B) and the width (s) of the slot is in the range $h/s=2$ to $h/s=10$, so that the velocity of emergence of the gas jet blown by the slot nozzle (3) on to the strip (B) is in the range of $0.3<\text{Mach}<2$, and a suctional removal gap (4) is disposed above the strip (B) at a distance of 5 to 25 nozzle distances (h) in the direction (L) in which the strip (B) runs upstream of the line of impingement of the gas jet emerging from the slot nozzle (3).

6 Claims, 1 Drawing Sheet

DEVICE FOR REMOVING LIQUID FROM THE SURFACE OF A MOVING STRIP

Figure 1:
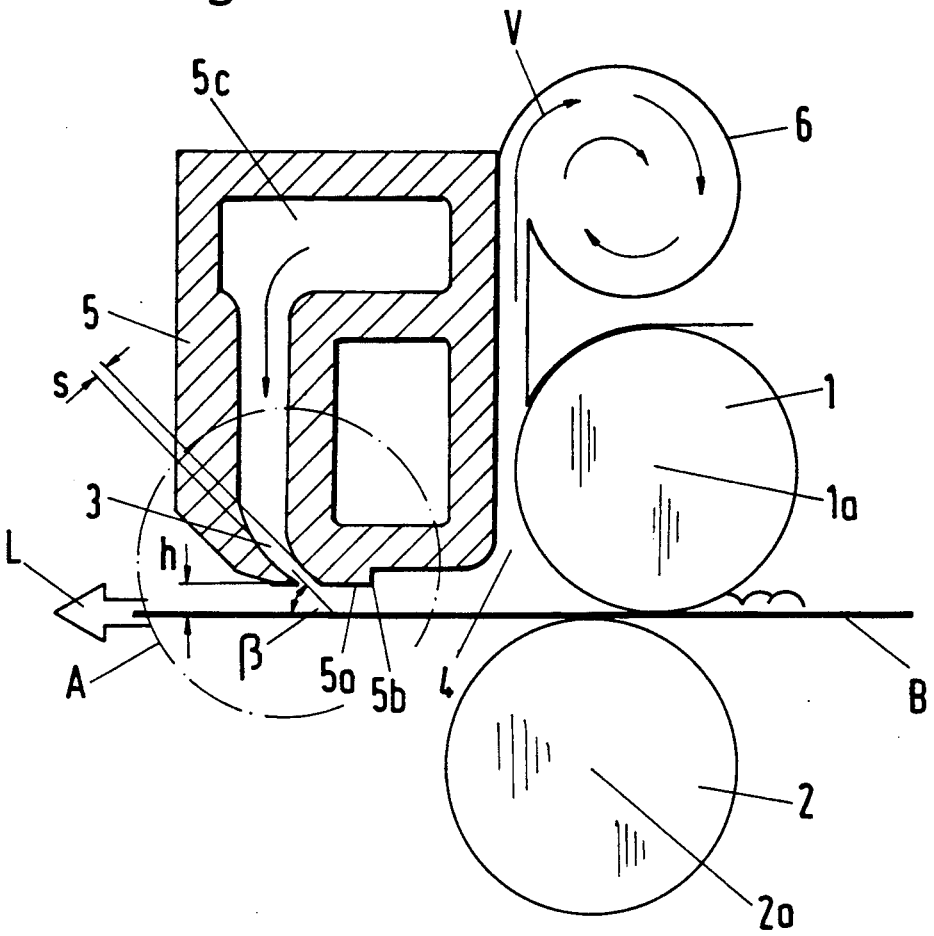

The invention relates to a device for removing liquid from the surface of a moving strip, more particularly a rolled strip on a roll stand, by means of a gas, more particularly air, blown on to the moving strip.

Such devices are required more particularly to remove from high-speed metal rolled strips residues of oil and emulsion which were applied to the strip as lubricants during the rolling operation. If the residues are inadequately removed, they remain between the individual turns when the strip is coiled and act as a lubricant film, so that the strip may tend to telescope—i.e., be displaced axially of the coiler during coiling. Moreover, as a rule only very small quantities of lubricant residue, referred to the surface of the rolled strip, are permitted for the further processing of the strips.

For many years attempts have been made to remove the lubricant residues from the strip by blowing, but the effect achieved is inadequate.

Due to these difficulties of the prior art systems of removal by blowing, modern roll stands used almost exclusively mechanical removal systems, comprising two rubber lips which are connected one after the other and are forced on to the surface of the strip.

The lubricant taken off the strip by the rubber lips is removed by suction therebetween. The disadvantage of these systems is that the rubber lips damage sensitive surfaces of the strip, more particularly with particles of dirt that become attached to the rubber lips.

It is an object of the invention to provide a device which obviates the aforedescribed disadvantages.

This problem is solved according to the invention by the features that disposed transversely of the direction in which the strip runs is a slot nozzle which is directed at the strip surface at an angle of 45° to 90° of its jet oppositely to the direction in which the strip runs, the ratio between the distance of the slot nozzle from the moving strip and the width of the slot is in the range $h/s=2$ to $h/s=10$, so that the velocity of emergence of the gas jet blown by the slot nozzle on to the strip is in the range of $0.3<\text{Mach}<2$, and a suctional removal gap is disposed above the strip at a distance of 5 to 25 nozzle distances in the direction in which the strip runs upstream of the line of impingement of the gas jet emerging from the slot nozzle.

In this way a fluidically optimum gas jet generates on the strip the wall shearing stress required for the adequate removal of the liquid film from the surface of the strip, and the liquid film, impelled by the gas jet, is removed by suction uniformly over the strip width by a suctional removal gap disposed upstream of the slot nozzle jet, viewed in the direction in which the strip runs. The suctional removal capacity of the gas jet is so adapted to the gas flow blown out by the slot nozzle that at least that volumetric flow which also contains the lubricant taken off is seized by the suctional gap and removed. This prevents blown-on lubricant from collecting on the roll stand construction or becoming dammed on the strip upstream of the blowing removal system and returning to the strip which has already been subjected to that system.

The invention starts from the realization that the essential reason for the unsatisfactory removal of the lubricant residues from the strip by the prior art blowing removal systems is that the velocity of impingement on the strip achieved by the nozzles and therefore the wall shearing stress acting on the surface of the strip are inadequate, due to the movement of the flow. In the conventional blowing nozzles the ratio between the nozzle distance and the width of the nozzle slot is substantially greater than the length of the nuclear jet, or in the case of overexpanding compressible jets greater than the jet length in which high velocity zones, so-called "Uberschalltönchen" are produced. (Cf. "The Dynamics and Thermodynamics of Compressible Fluids" by Ascher H. Schapiro, Vol. I; The Ronald Press Co., New York, p. 454: "Examples of overdeveloped and underdeveloped jets").

In contrast, according to the invention the ratio between the distance h of the nozzle from the moving strip and the width s of the gas jet is in the range of 2 to 10. This ensures that the gas jet actually reaches the highest possible velocity of impingement for a particular inflow-situation to the nozzle. The invention therefore enables satisfactory results to be obtained from economic aspects also. The design and arrangement of the slot nozzle according to the invention enables the velocities of 300 meters per second or more to be reached for the removal of rolling oil from the metal strip in the customary operation of the blowing removal nozzle. According to the invention the required result can be achieved even with comparatively low pressure of approximately only a maximum of 2 bar, while with the prior art nozzles an air pressure of 4–6 bar is not yet adequate for cleaning the metal strip.

The invention can be put into effect with or without preceding squeeze rolls in the direction in which the strip runs. If no squeeze rolls are used or a device for the removal of rolling oil or emulsion must be disposed at a fairly large distance from the squeeze rolls, preferably two slot nozzles are used which are disposed oppositely inclined to one another above and if necessary below the strip. In that case the suctional removal slot is situated between the two slot nozzles. In that case the suctional removal system must be so dimensioned that the gas flows, including the liquid, blown by the two clot nozzles on to the strip are seized by the suctional removal system.

The required velocity of impingement of the gas flowing out of the nozzle and therefore the necessary pressure at which the slot nozzles are supplied are determined by the properties of the liquids to be removed from the strip. In the case of a relatively hot strip and rolling emulsion, relatively low velocities of impingement in the range of approximately Mach 0.3, corresponding to approximately 100 meters per second, are adequate. With rolling oils of higher velocity, experience shows that velocities of impingement on the surface of the strip of around Mach 1, corresponding to approximately 300 meters per second, are required for medium to high rolling speeds. Even higher velocities of impingement can be reached if the nozzle slot is constructed after the fashion of a Lavall nozzle with a very narrow cross-section followed by a widened portion shaped in accordance with gas dynamics, this allowing an acceleration of the flow to velocities higher than the speed of sound.

Figure 2:
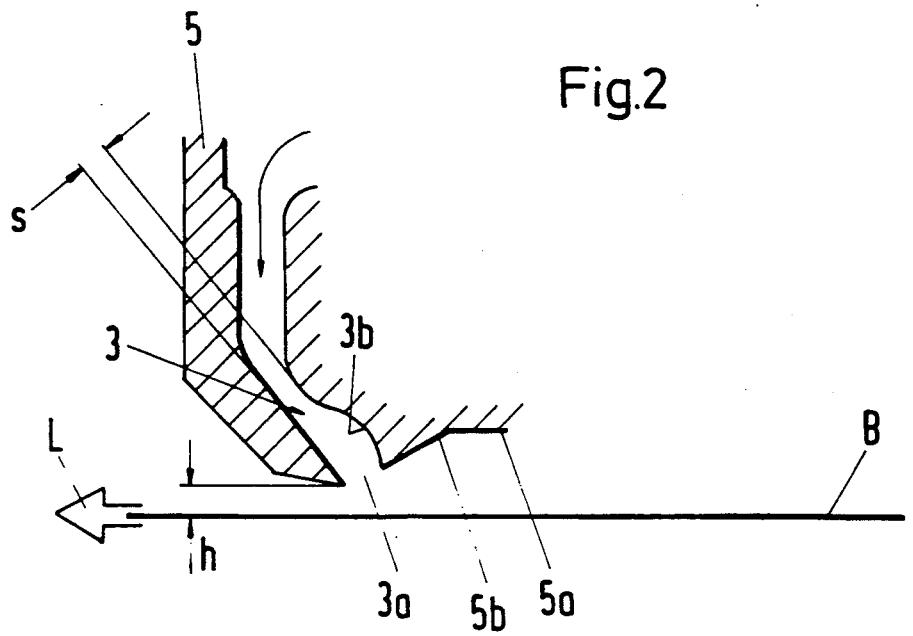

An embodiment of the invention will now be explained in greater detail with reference to an embodiment thereof diagrammatically illustrated in the drawings, wherein:

FIG. 1 is a section through a device for the removal of liquid from the surface of a moving strip, and FIG. 2 is a detail A to an enlarged scale of a variant form of the device shown in FIG. 1.

Referring to FIG. 1, a squeeze roll 1, 2 is disposed respectively above and below a strip B. To prevent any rolling effect from taking place, the axes 1*a*, 2*a* of the squeeze rolls 1, 2 are slightly offset in relation to one another in the direction in which the strip runs. Disposed downstream of the squeeze roll 1, viewed in the direction in which the strip runs, is a slot nozzle 3 which directs a gas jet on to the surface of the strip inclined by an angle $\beta$ between 45° and 90° oppositely to the direction L in which the strip B runs. The slot nozzle 3 is disposed at a distance h from the surface of the strip B. If the nozzle opening is not widened in the zone of the nozzle outlet aperture the gas jet emerging from the nozzle has the same width s as the slot of the nozzle 3 itself.

In the example illustrated a suction gap 4 is formed on one side by a correspondingly shaped nozzle body 5 and on the other side by the squeeze roll 1.

In the zone between the nozzle gap 3*a* and the suction gap 4 the underside 5*a* of the nozzle body 5 has a step 5*b* ensuring that the nozzle body 5 does not affect the field of velocity of the gas jet. In this way the full velocity of impingement of the gas jet exerts its action with the wall shearing stress produced on the surface of the strip. The slot nozzle 3 is supplied via a supply channel 5*c* extending over the whole strip width.

The suction gap 4 is connected via a correspondingly narrow rectangular channel over the whole width of the strip B to a suctional removal whirl tube 6. The volumetric flow to be removed by suction is conveniently removed by the suction removal whirl tube 6 on both sides—i.e., both forwardly and rearwardly as illustrated in the drawing. In the case of smaller working widths, even the removal of the suctional flow on one side only may suffice. Flow arrows on the drawings clearly show the effect of the suctional removal whirl tube 6.

Departing from the other size ratios required for the diagrammatic drawing, the suction gap 4 is substantially larger in size than the nozzle gap 3*a*, since on the one hand the speed of suctional removal is substantially lower than the speed of blowing from the nozzle gap 3*a*, and on the other hand the volumetric flow to be removed by suction must be larger than that proportion which is sucked in as well as the volumetric flow emerging from the nozzle gap, for example, at the edges of the strip B.

In the case of a strip B which must be dried on both sides, something which is usually the case with roll stands, disposed upstream of the lower squeeze roll 2 is a similar kind of device which has been omitted to simplify the drawing.

The slot nozzle 3 can take various forms. In the embodiment illustrated to an enlarged scale in FIG. 2 it has a widened portion 3*b* in the nozzle gap 3*a*, similarly to a Lavall nozzle. In this nozzle the width of the jet from the slot is equal to the width s at the narrowest place of the slot nozzle 3. The widened portion 3*b* ensures that the flow is accelerated beyond the speed of sound and impinges on the strip D with an even higher velocity of impingement. In this way the removal effect of the gas jet emerging from the nozzle 3 can be even further enhanced by relatively simple means, namely solely by a suitable design of the nozzle gap 3*a*, without the necessity of uneconomically increasing the nozzle pressure for this purpose.

We claim:

1. Device for removing a liquid from the surface of a moving strip, comprising means for blowing a jet of gas onto said strip so as to aerodynamically lift said liquid off the surface of said strip, said blowing means including a slot nozzle which is disposed transversely of the direction in which the strip is moving and is directed at said strip surface at an angle of between about 45° to 90° opposite to the direction of strip movement, wherein the ratio of the distance (h) of said slot nozzle from said moving strip and the width (s) of said slot nozzle is in the range $h/s=2$ to $h/s=10$, so that the velocity of the gas jet emerging from said slot nozzle onto said strip is in the range of $0.3<\text{Mach}<2$, and means for suctioning said aerodynamically lifted liquid away from said strip, said suctioning means including a suctional removal gap above said moving strip located at a distance which is 5 to 25 times as great as said slot nozzle distance (h) and upstream of a line of impingement of the gas jet emerging from the slot nozzle.

2. The device of claim 1 wherein said gas is air.

3. The device of claim 1 wherein said strip is a rolled strip.

4. The device of claim 1 wherein said suctioning means includes a swirl tube.

5. The device of claim 1 wherein one side of said suction removal gap is delimited by a squeeze roll.

6. The device of claim 1 wherein said slot nozzle comprises a Lavall nozzle having a part with a narrow cross section part and a widened part.

* * * * *